US010315293B2

(12) United States Patent
Kviberg et al.

(10) Patent No.: US 10,315,293 B2
(45) Date of Patent: Jun. 11, 2019

(54) ELECTRIC POWER TOOL

(75) Inventors: Erik Markus Peder Kviberg, Nykvarn (SE); Anders Urban Nelson, Alvsjo (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 460 days.

(21) Appl. No.: 14/129,862

(22) PCT Filed: Jun. 14, 2012

(86) PCT No.: PCT/EP2012/061317

§ 371 (c)(1),
(2), (4) Date: Dec. 27, 2013

(87) PCT Pub. No.: WO2013/000725

PCT Pub. Date: Jan. 3, 2013

(65) Prior Publication Data

US 2014/0124228 A1 May 8, 2014

(30) Foreign Application Priority Data

Jun. 30, 2011 (SE) ..... 1150616

(51) Int. Cl.
*B25B 21/02* (2006.01)

(52) U.S. Cl.
CPC ..... *B25B 21/02* (2013.01)

(58) Field of Classification Search
CPC . B25F 5/00; B25F 5/001; B25B 21/00; B25B 21/02
USPC ..... 173/93, 1–2, 213, 90, 93.5, 170–171; 81/12.1, 124.6
See application file for complete search history.

(56) References Cited

U.S. PATENT DOCUMENTS 3,592,274 A * 7/1971 Young ..... B25B 23/1405 173/93.6
3,710,873 A * 1/1973 Allen ..... B25B 23/1453 173/176
3,735,824 A * 5/1973 Astrom ..... B23Q 1/015 173/210

(Continued)

FOREIGN PATENT DOCUMENTS

EP 1 930 124 A1 6/2008
EP 2 305 432 A2 4/2011

(Continued)

OTHER PUBLICATIONS

International Search Report (ISR) dated Oct. 4, 2012 (in English) issued in International Application No. PCT/EP2012/061317.

*Primary Examiner* — Robert F Long
(74) *Attorney, Agent, or Firm* — Holtz, Holtz & Volek PC

(57) ABSTRACT

An electric torque delivering impulse tool includes a housing with a front end and a back end, an electric torque delivering motor with a rotor that is arranged to rotate with respect to a stator, an output shaft arranged at the front end of the housing, and a pulse unit intermittently coupling the motor to the output shaft, wherein the pulse unit includes an inertia drive member that is connected to the rotor. The rotor and the inertia drive member are rigidly assembled to each other without play so as to form one integrated rotatable structure which is mounted as one single unit inside the housing.

12 Claims, 3 Drawing Sheets

(56) References Cited

U.S. PATENT DOCUMENTS 3,804,180 A * 4/1974 Gelfand ..... B25B 21/02 173/117
3,908,768 A * 9/1975 Hess ..... B25B 21/02 173/93
3,952,814 A * 4/1976 Gelfand ..... B25B 21/02 173/93
4,075,927 A * 2/1978 Frazier ..... B23B 31/261 279/142
4,232,750 A * 11/1980 Antipov ..... B25B 21/02 173/93.6
4,347,902 A 9/1982 Wallace et al.
4,541,160 A * 9/1985 Roberts ..... F16C 1/02 29/401.1
4,824,298 A * 4/1989 Lippacher ..... B23B 31/008 173/48
5,092,410 A 3/1992 Wallace et al.
5,375,637 A * 12/1994 Matsumoto ..... B23Q 1/0009 144/134.1
5,845,718 A * 12/1998 Cooper ..... B23Q 5/027 173/117
6,003,618 A * 12/1999 Wallace ..... B25B 21/026 173/93
6,196,332 B1 * 3/2001 Albert ..... B25B 21/00 173/176
6,220,115 B1 * 4/2001 Hirn ..... F16H 49/001 74/640
6,863,134 B2 * 3/2005 Seith ..... B25B 21/026 173/1
6,918,449 B2 * 7/2005 Shinagawa ..... B25B 21/02 173/117
7,453,225 B2 * 11/2008 Friberg ..... B25B 23/1405 173/183
8,678,262 B2 * 3/2014 Zhou ..... B25C 1/184 227/113
9,555,532 B2 * 1/2017 Amend ..... B25B 21/026
2002/0020538 A1 * 2/2002 Giardino ..... B25B 23/1405 173/176
2003/0173178 A1 * 9/2003 Sasaki ..... B25B 21/02 192/3.51
2004/0074344 A1 * 4/2004 Carroll ..... B25B 13/06 81/121.1
2005/0236167 A1 * 10/2005 Andersson ..... B25D 16/00 173/90
2008/0135269 A1 * 6/2008 Friberg ..... B25B 23/1405 173/93.5
2009/0133894 A1 * 5/2009 Mizuhara ..... B25B 21/02 173/217
2009/0321098 A1 * 12/2009 Hull ..... B23Q 5/06 173/1
2010/0000749 A1 * 1/2010 Andel ..... B25B 21/026 173/48
2011/0079407 A1 4/2011 Iimura et al.
2011/0186316 A1 * 8/2011 Barhitte ..... B25F 5/00 173/29
2011/0236180 A1 * 9/2011 Nelson ..... F01C 13/02 415/1
2012/0255749 A1 * 10/2012 Seith ..... B25B 13/06 173/1
2012/0279736 A1 * 11/2012 Tanimoto ..... B25B 21/02 173/2
2013/0008679 A1 * 1/2013 Nishikawa ..... B25B 23/1475 173/93
2013/0062088 A1 * 3/2013 Mashiko ..... B25B 21/026 173/2
2013/0264087 A1 * 10/2013 Harada ..... B25B 21/00 173/213
2013/0277065 A1 * 10/2013 Hallundbæk ..... E21B 43/121 166/372
2013/0333910 A1 * 12/2013 Tanimoto ..... B25B 21/02 173/176
2015/0217433 A1 * 8/2015 Seith ..... B25B 23/0035 81/124.6
2015/0343617 A1 * 12/2015 Kondo ..... B25B 21/02 173/93
2016/0121470 A1 * 5/2016 Mayer ..... B25B 23/1475 173/181
2016/0195422 A1 * 7/2016 Nelson ..... B25B 21/02 73/290 V
2016/0288308 A1 * 10/2016 Kuhnle ..... B25F 5/001
2017/0028537 A1 * 2/2017 McClung ..... B25B 21/026

FOREIGN PATENT DOCUMENTS

GB 2 065 525 A 7/1981
WO WO 91/14541 A1 10/1991

* cited by examiner

ELECTRIC POWER TOOL

The invention relates to an electric torque delivering impulse tool, such as e.g. a screw machine. In particular the invention relates to a tool with an interconnected electric motor and a torque impulse generating pulse unit.

In a conventional torque delivering impulse tool the motor and the torque impulse generating pulse unit are mounted with individually bearings and the motor and the pulse unit are interconnected by means of e.g. a hexagonal or quadratic male and female connection part, which are interconnected such that a play or allowance by necessity exists between them. The allowance between the interconnected parts is inevitable for assembly with respect to manufacturing tolerances of the parts.

A problem inherent in this conventional arrangement is that an increasing gap is formed between e.g. the hexagonal male and female connection parts. This gap will increase due to the joint work of the motor, on the one hand, and the partly opposed work of the pulse unit, on the other hand. In this procedure the connection will slowly degrade such that it will have to be replaced at one time sooner or later.

Further, this kind of connection has considerable backlash and elasticity. Therefore, there will be an irresolute transmission of the torque pulses generated in the system and as a consequence the contribution of torque from the energy stored in the motor part will not be optimal.

Hence, there is a need new of an improved connection arrangement between the motor and the pulse unit, which allows for a prolonged life time of the motor and the pulse unit.

SUMMARY OF THE INVENTION

An object of the invention is to provide an electric torque delivering impulse tool, which is more durable and more efficient than a conventional torque delivering impulse tool. A specific object of the invention is to provide an improved connection between the motor and the pulse unit, in order to achieve a higher efficiency, a reduced weight and/or a prolonged life time for the tool.

The invention relates to an electric torque delivering impulse tool comprising: a housing with a front end and a back end, an electric torque delivering motor with a rotor that is arranged to rotate with respect to a stator, an output shaft arranged at the front end of the housing, and a pulse unit intermittently coupling said motor to said output shaft, wherein the pulse unit comprises an inertia drive member that is connected to said motor rotor. The rotor and the inertia drive member are rigidly assembled to each other without play to form one integrated rotatable structure which is mounted as one single unit inside said housing.

With the tool according to the invention the possibility of movement between the interconnected parts of the tool is restricted, such that virtually no wear due to fatigue or repeated strokes will be present.

Further, the construction of the tool will be more compact with respect to that of prior art arrangements. This is an advantage as the tool may be made smaller, and because the tool may be arranged to absorb the forces produced by the motor and the pulse unit in a more efficient manner, which leads to an overall more agreeable manoeuvring of the tool for the operator.

In the prior art, the rotor and inertia drive member are individually journalled with respect to the housing, typically using three or more bearings. Due to manufacturing tolerances and the different axial locations of the journal bearings in the structure, such a system can never be truly coaxial. Any run-outs or misalignments of housing parts of the outer structure will inflict an angularity between rotor and inertia drive member. This angularity will in turn reduce the effective stiffness of the torque transmitting hexagonal joint that conventionally connects the rotor and the inertia drive member in such a way that a significant elasticity is introduced into the system in conflict with the desired rigidity.

The elasticity is increased by the fact that the hexagonal joint has small radial dimensions, necessary to allow the motor bearing to be assembled outside the shaft. Since the rotor and inertia drive members are assembled one at a time into the supporting structure, the hexagonal joint must have enough backlash to allow the parts to slide together during assembly and disassembly. Given the necessary manufacturing tolerances of such hexagonal joint parts and allowance for dimensional alterations during hardening processes, the angular backlash will have an initial value of typically some degrees.

The repetitive torque pulses travelling back and forth through the hexagonal joint during operation will gradually deteriorate the joint by wear and fatigue effects in such a manner that the backlash tends to increase over time. This reduces further the effective rigidity. Other fail modes like splintered or broken shafts often occur and limit the lifetime of the traditional system.

The idea of the invention, on the other hand, is that the rotor and the inertia drive member should be rigidly assembled to each other without a gap or play, so as to form one integrated rotatable structure which is mounted as one single unit inside said housing. With the inventive solution, any movement of the rotor and the inertia drive member with respect to the housing will be uniform, as opposed to the prior art, where the rotor and the inertia drive member are allowed to move individually with respect to each other.

One advantage of the tool according to the invention is that it will have a higher specific torque output than a conventional one. Another advantage is that due to the integrated rotatable structure of the rotor and the inertia drive member it is possible to exclude one or more journal bearings. This will reduce the size, weight and friction in the system. The friction is important to keep as low as possible as a system with low inherent friction generates less heat than a system with a higher inherent friction.

Additional objects and advantages of the invention will appear from the following specification and claims.

SHORT DESCRIPTION OF THE DRAWINGS

In the following detailed description reference is made to the accompanying drawings, of which:

DETAILED DESCRIPTION OF ONE EMBODIMENT OF THE INVENTION

Figure 1:
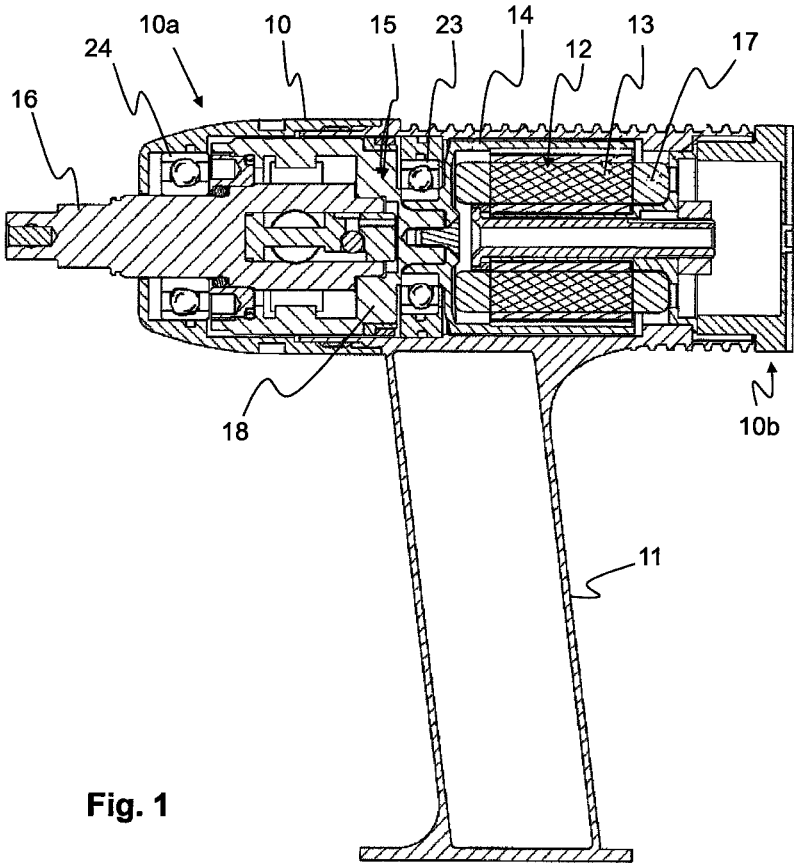
FIG. 1 is a cross sectional view of an electric torque delivering impulse tool according to a first embodiment of the invention.

The electric torque delivering impulse tool schematically shown in FIG. 1 comprises a housing 10 and a handle 11. The handle 11 may include an actuator (not shown), preferably in the form of a trigger, for controlling the power of the tool. Further the handle 11 may include a connection to a battery or to an electric power net. The tool further comprises an electric motor 12 including a stator 13 and a rotor 14, and a torque impulse generating pulse unit 15 with an output shaft 16 for connection to a socket (not shown).

The function of a torque impulse generating pulse unit 15 is well known to a person skilled in the art and is not described in detail in this application. A more detailed description of the function of a pulse unit is described in the international patent application WO 91/14541.

Figure 2:
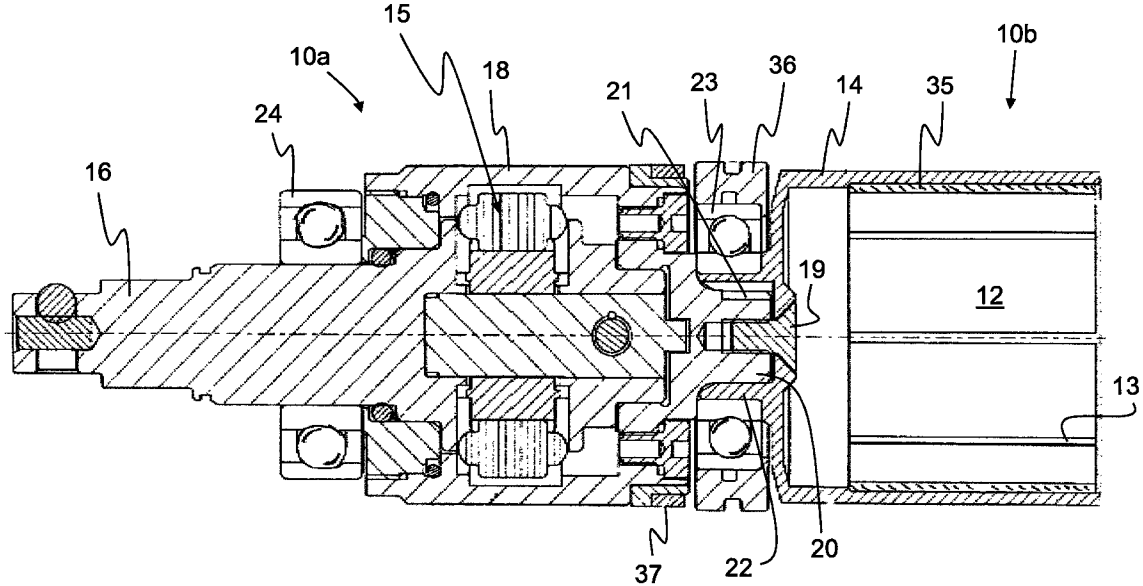
FIG. 2 is a detailed view of a part of the tool shown in FIG. 1.
Figure 3:
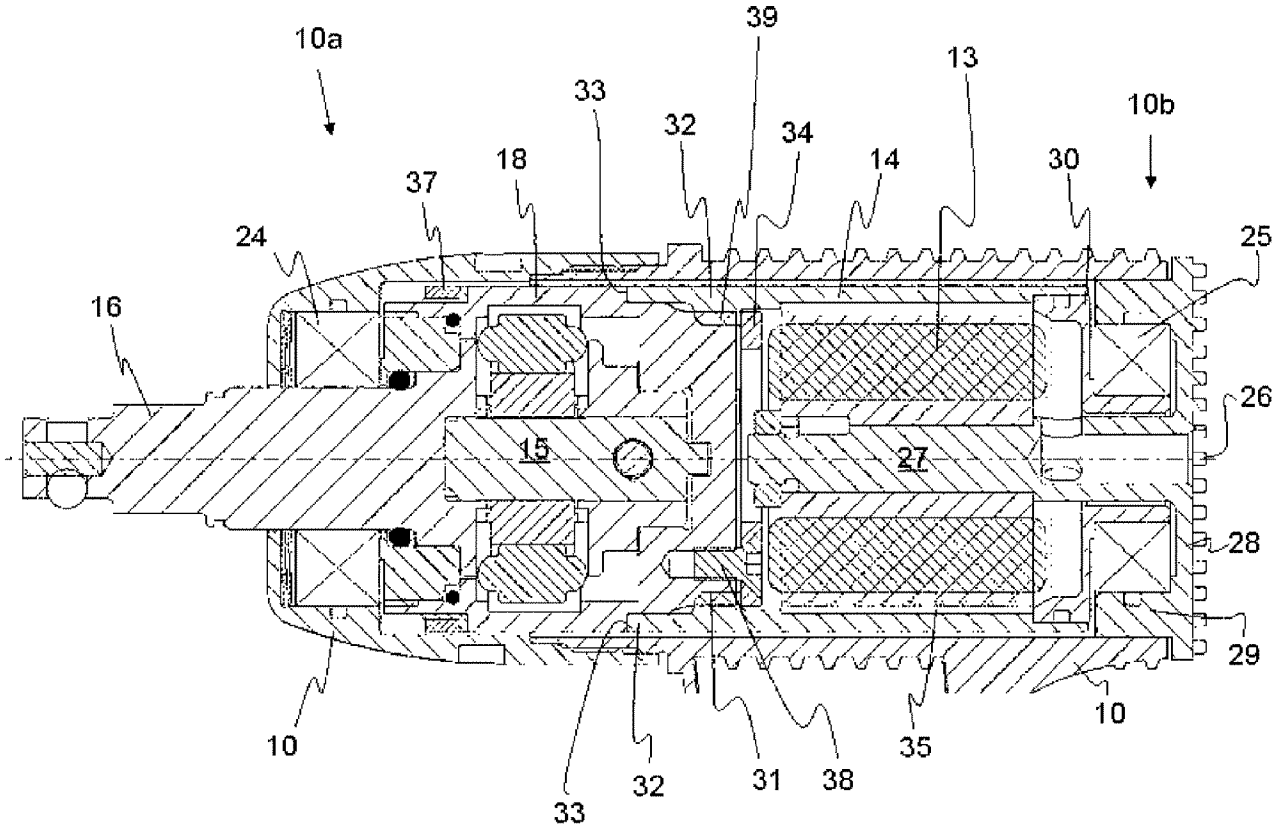
FIG. 3 is a detailed view of a part of an electric torque delivering impulse tool according to a second embodiment of the invention.

A detailed view of the motor 12 and the pulse unit 15 of the first embodiment of the invention is shown in FIG. 2. An advantage of the invention is that the motor rotor 14 and the pulse unit 15 are intimately assembled to form one single structure, such that there is no gap or play between the interconnected parts. This may be achieved in different manners whereof two possible embodiments are shown in FIGS. 2 and 3, respectively.

In the first embodiment, e.g. the embodiment shown in FIGS. 1 and 2, the stator 13 is arranged inside the rotor 14. Typically the stator 13 comprises a conventional electrical winding 17. The rotor 14 comprises a permanent magnet 35, which is located on the inside of the rotor 14. In a not shown alternative embodiment of the invention the rotor is arranged inside the stator, instead of outside it.

In the embodiment shown in FIGS. 1 and 2 the rotor 14 is connected to a cylindrical inertia drive member 18 of the pulse unit 15 via a male and female connection part 20 and 22, respectively. In the shown embodiment the connection of the male connection part 20 to the female connection part 22 consists of a splined coupling 21 between the interior of the female connection 22 and the exterior of the male connection part 20. As discussed in the background part of this application this splined connection 21 would be the sole connection between the pulse unit and the motor in a conventional electric torque delivering impulse tool.

In the inventive arrangement a screw 19 is centrally arranged through the rotor 14 and into the male connection 20. This arrangement creates a clamp force assures that the cylindrical inertia drive member 18 and the rotor 14 are both rigidly and fixedly assembled to each other, e.g. such that no mutual movement in either the axial, angular or radial direction is permitted between them. As alternative a screw could be arranged from the male part 20 into the female part where it could be fastened, e.g. by means of a nut.

By means of this screw attachment the rotor and the inertia drive member are assembled to each other so as to form one integrated rotatable structure which is mounted as one single unit inside said housing. This implies that the unit formed by the rotor 14 and the inertia drive member 18 may be mounted on joint bearings, and as a consequence only two bearings are needed in total for said unit.

In order to assure that both the rotor 14 and the inertia drive member 18 are stabilised with respect to the housing 10, a central bearing 23, e.g. a ball bearing, is clamped on the outside of the female part 22. The outside of this central bearing 23 is attached via a support ring 36 to the inside of the housing 10. Hence, by means of this central bearing 23 both the rotor 14 and the inertia drive member 18 are stabilised, both with respect to each other and to the housing 10.

Apart from this central bearing 23, only one additional bearing for stabilising the combined motor-pulse unit is needed inside the housing. This additional bearing could be arranged either at the back end 10*b* of the housing 10, e.g. on the rotor, or at the front end 10*a* of the housing on the inertia drive member 18.

In the shown embodiment, a front bearing 24, a ball bearing, is arranged on the output shaft 16. The front bearing 24 is arranged in a conventional manner such that it stabilises the output shaft 16 in both the axial and radial direction. Further though, it contributes to stabilise the inertia drive member 18 in the axial direction, such that no axial movement will be allowed between the inertia drive member and the output shaft 16.

In the second embodiment, which is shown in FIG. 3, the interconnection between the rotor 14 and the inertia drive member 18 is arranged in a different manner. In this embodiment the rotor 14 is also arranged outside stator 13. A first difference with respect to the first embodiment is the location of the bearings. In the second embodiment a rear bearing 25, e.g. an axial bearing, is arranged at the rear of the housing 10, behind the motor 12 and in coaxial alignment with the stator 13. The rear bearing 25 is arranged inside a solid back end part 26, which comprises a central bar 27 that is inserted into, and fixedly connected to, the stator 13. The solid back end part 26 further includes a back plate 28 and a block ring 29 that extends forward from the back plate 28.

The rear bearing 25 is arranged inside the block ring 29 of the solid back end part 26. An S-shaped bearing connection part 30 is arranged with one end inside the rear bearing 25 and the opposed end attached to the inside of the rotor 14. With this location, the rear bearing 25 stabilises the rotor 14 with respect to both the housing 10 and the stator 13. This double stabilising effect is accomplished by means of the solid back end part 26, which solidly connects both the stator 13 and the housing 10 to the rotor 14. The connection to the rotor 14 is of course achieved via the rear bearing 25 and the bearing connection part 30.

A further difference of this second embodiment with respect to the first embodiment lies in the connection between the rotor 14 and the inertia drive member 18. In this second embodiment the rotor 14 is assembled to the cylindrical inertia drive member 18 by means of a splined coupling 31. Apart from the splined coupling 31, the front end 32 of the rotor 14 abuts a collar 33 on the rear periphery 39 of the inertia drive member 18. This abutment ensures that the rotor 14 may not move forward with respect to the inertia drive member 18 and vice versa.

In order to prohibit mutual movement in the opposite axial direction, i.e. in the separating direction, a block 34 in the form of a solid plate has been provided. The block 34 restricts the movement of the splined coupling part 32 of the rotor 14 away from the splined coupling part 39 of the inertia drive member 18. The block 34 is fastened to a solid portion of the inertia drive member 18 by means of at least three screws 38. This arrangement provides a very solid connection between the rotor 14 and the inertia drive member 18 in both the axial and the radial direction. No central bearing, arranged around the connection of the rotor 14 and the inertia drive member 18, is arranged in this second embodiment.

In the second embodiment a front bearing 24 is arranged on the output shaft 16, in the same manner as in the first embodiment. Likewise, the front bearing 24 stabilises the output shaft 16 in both the axial and radial direction. In addition it stabilises the inertia drive member 18 in the axial direction, such that no axial movement will be allowed between the inertia drive member 18 and the output shaft 16.

Both embodiments of the invention may include a resolver magnet 37 for detecting the rotational movement of the rotating parts of the torque delivering tool. By means of said detection, it is possible to calculate the retardation magnitude of said rotating parts. This arrangement per se is known to a skilled person and is described in e.g. EP 1 379 361 B1.

The optimal positioning of the resolver magnet 37 is not the same in both of the presented embodiments. In the first embodiment, which is illustrated in FIG. 2, the resolver magnet 37 is located around the rear end of the inertia drive member 18, close to the central bearing 23.

In the second embodiment, which is illustrated in FIG. 3, the resolver magnet 37 is instead located around the front end of the inertia drive member 18, close to the front bearing 24. Hence, in both embodiments the resolver magnet 37 is located close to a bearing. This is advantageous, because of the fixing action of the bearing that implies that the disturbance of the rotation of the resolver magnet 37 will be kept at a minimum.

In a third, not shown, embodiment the rotor 14 and the inertia drive member 18 are formed as a unit from one single block of metal. In such an embodiment the rotor 14 and the inertia drive member 18 will of course be absolutely rigidly assembled to each other, without any displacement or offset movement between them. Care will have to be taken to choose a material for the integrated unit that is hard enough to withstand the pulses that act on the inertia drive member 18, but that at the same time is magnetic, such that the magnetic field of the permanent magnets 35 on the rotor 14 will not be negatively affected. It is, however, obvious to a person skilled in the art to select a material that may be given the properties desired for the purpose. Preferably, such an integrated rotor 14 and inertia drive member 18 will be journalled in two bearings only, either one front bearing and one back bearing, or one central bearing and one back or front bearing.

Above, by way of example, the invention has been described with reference to specific embodiments. The invention is however not limited to either of these embodiments. Instead, the invention is limited by the scope of the following claims.

The invention claimed is:

1. An electric torque delivering impulse tool comprising:
- a housing with a front end and a back end;
- an electric torque delivering motor with a rotor that is arranged to rotate with respect to a stator;
- an output shaft arranged at the front end of the housing; and
- a pulse unit which is coupled to said motor and delivers torque impulses to said output shaft, wherein the pulse unit comprises:
  - an inertia drive member that is coaxially rotatable with said output shaft;
  - a chamber in which a rear portion of said output shaft is received; and
  - pulse unit elements arranged between the inertia drive member and said rear portion of said output shaft,
- wherein the inertia drive member of the pulse unit is connected to said rotor by a mating connection such that the rotor and the inertia drive member are rigidly assembled to each other such that no relative axial movement is permitted between the rotor and the inertia drive member, and to form one integrated rotatable structure including the rotor and the inertia drive member, said one integrated rotatable structure being mounted as one single unit inside said housing, and
- wherein the rotor is fixed to the inertia drive member by a connection between a male connection part and a female connection part for transferring torques there between, and wherein a central bearing is clamped outside said male and female connection parts and arranged in a fixed connection to the housing to prevent any mutual axial movement between said male and female connection parts and to fix said male and female connection parts with respect to the housing.

2. The electric torque delivering impulse tool according to claim 1, wherein the integrated rotatable structure is mounted only in two bearings.

3. An electric torque delivering impulse tool comprising:
- a housing with a front end and a back end;
- an electric torque delivering motor with a rotor that is arranged to rotate with respect to a stator;
- an output shaft arranged at the front end of the housing; and
- a pulse unit which is coupled to said motor and delivers torque impulses to said output shaft, wherein the pulse unit comprises:
  - an inertia drive member that is coaxially rotatable with said output shaft;
  - a chamber in which a rear portion of said output shaft is received; and
  - pulse unit elements arranged between the inertia drive member and said rear portion of said output shaft,
- wherein the inertia drive member of the pulse unit is connected to said rotor by a mating connection such that the rotor and the inertia drive member are rigidly assembled to each other such that no relative axial movement is permitted between the rotor and the inertia drive member, and to form one integrated rotatable structure including the rotor and the inertia drive member, said one integrated rotatable structure being mounted as one single unit inside said housing, and
- wherein the rotor is fixed to the inertia drive member by a splined coupling which is locked in position by a screw attached block.

4. The electric torque delivering impulse tool according to claim 3, wherein the rotor has a splined front end which is fixed outside a splined back end of the inertia drive member to form said splined coupling and wherein the front end of the rotor abuts a collar on the outside of the inertia drive member, the screw attached block being arranged to lock the rotor and the inertia drive member in a mutually abutted position.

5. The electric torque delivering impulse tool according to claim 4, wherein a rear bearing is connected to the rotor at a rear of the motor.

6. The electric torque delivering impulse tool according to claim 5, wherein the rear bearing is in coaxial alignment with the stator and located forward of a solid back end part wherein the back end part comprises:
- a central bar that is inserted into, and fixedly connected to, the stator;
- a back plate; and
- a block ring that extends forward from the back plate and wherein the rear bearing is supported by said block ring.

7. The electric torque delivering impulse tool according to claim 6, wherein the rear bearing is arranged inside the block ring and wherein an S shaped bearing connection part is arranged with one end inside the rear bearing and an opposed end attached to the rotor.

8. The electric torque delivering impulse tool according to claim 1, wherein a screw is centrally provided between the male and female connection parts to achieve an axial clamp force that fixes the male and female connection parts to each other.

9. The electric torque delivering impulse tool according to claim 1, wherein the male and female connection parts are interconnected by a splined coupling that connects an exterior of the male connection part to an interior of the female connection part.

10. The electric torque delivering impulse tool according to claim 1, wherein a front bearing is arranged between the housing and the output shaft.

11. The electric torque delivering impulse tool according to claim 1, wherein a resolver magnet for detecting rotational movement of the rotating parts of the electric torque delivering impulse tool is arranged around a periphery of the inertia drive member.

12. The electric torque delivering impulse tool according to claim 8, wherein the male and female connection parts are interconnected by a splined coupling that connects an exterior of the male connection part to an interior of the female connection part.

* * * * *